US005921328A

United States Patent [19]

Babineau et al.

[11] Patent Number: 5,921,328

[45] Date of Patent: Jul. 13, 1999

[54] SOIL SAMPLER

[75] Inventors: James W. Babineau, Newton, Mass.; Scott E. Blouin; James Garfield Shinn, II, both of South Royalton, Vt.

[73] Assignee: Applied Research Associates, Inc., Albuquerque, N.M.

[21] Appl. No.: 08/854,700

[22] Filed: May 12, 1997

[51] Int. Cl.[6] ..... E21B 49/02

[52] U.S. Cl. ..... 175/20; 175/58

[58] Field of Search ..... 175/20, 22, 23, 175/58, 257, 246

[56] References Cited

U.S. PATENT DOCUMENTS

| | | | |
|---|---|---|---|
| 763,212 | 6/1904 | Shuman | 175/23 |
| 1,671,136 | 5/1928 | Stokes | 175/257 |
| 1,969,251 | 8/1934 | Bald | 175/23 |
| 2,020,599 | 11/1935 | Barrett et al. | 175/257 |
| 2,251,679 | 8/1941 | Kinnear | 175/247 |
| 3,042,124 | 7/1962 | Andersson . | |
| 3,075,588 | 1/1963 | Mitchell . | |
| 3,169,592 | 2/1965 | Kammerer | 175/257 |
| 3,367,188 | 2/1968 | Robinson . | |
| 3,409,081 | 11/1968 | Brown | 175/257 |
| 4,549,612 | 10/1985 | Cushing . | |
| 4,953,637 | 9/1990 | Starr et al. . | |
| 5,186,263 | 2/1993 | Kejr et al. . | |
| 5,211,249 | 5/1993 | Richter et al. . | |
| 5,474,140 | 12/1995 | Stevens . | |
| 5,542,481 | 8/1996 | Scott | 175/23 |

*Primary Examiner*—Hoang C. Dang
*Attorney, Agent, or Firm*—Jacobson, Price, Holman & Stern, PLLC

[57] ABSTRACT

An apparatus for obtaining subterranean soil samples includes an elongated housing having a passageway extending longitudinally therethrough, a tip assembly movable through the passageway, and a locking device for releasably preventing the tip assembly from moving from a first portion of the passageway to a second portion of the passageway. The sampling method includes the steps of inserting the sampling apparatus into the ground, unlocking the tip assembly, pulling the tip assembly through the passageway and retaining the tip assembly in the second portion of the passageway. A device is provided for creating a vacuum pressure above the sample material as the tip assembly is retracted and for retaining the sample material in a sample chamber.

45 Claims, 5 Drawing Sheets

SOIL SAMPLER

FIELD OF THE INVENTION

The present invention relates to a method and a device for obtaining subterranean soil samples and for obtaining and retaining material samples including loose grains.

BACKGROUND OF THE INVENTION

Cone penetrometer testing (CPT) is commonly used for the geotechnical and environmental characterization of subterranean media. Some aspects of this characterization require the analysis of samples of soil retrieved from subterranean layers. Appropriately used, CPT has become a cost effective alternative to other methods for obtaining precise stratigraphic and chemical information to depths over 300 feet below the surface of the ground.

A CPT system typically involves the deployment of a cylindrical probe through subterranean media at a constant velocity specified by industrial standards. Sensors are housed in the cylindrical probe having a conical point that is pushed vertically without rotation into the ground via hydraulic or other constant velocity ram systems. As the probe advances, additional cylindrical tubes or rods are added to a string of tubes or rods to increase the effective length of the probe.

The vertical load exerted on the probe as it is advanced can exceed thirty tons of force. This force is preferably developed by the dead weight of the vehicle to which the ram system is attached or alternatively by a reaction against earth anchors.

The lower end of the CPT probe, approximately 1.5 inches in diameter, contains load sensors for measuring the vertical bearing load on the conical surface section of the probe and the vertical frictional or shear load on the external surface of a short cylindrical section disposed immediately above the conical surface section. These two loads are measured at multiple intervals of depth or time to produce a continuous representation of various geomechanical soil properties as a function of depth. In addition, empirical correlations are commonly used to develop stratigraphic maps from these load measurements.

Optionally, additional sensors are deployed within the probe to measure the pressure of the pore fluid, electrical resistance and moisture content of the soil matrix, alkalinity and oxidation reduction potential of the subterranean media, and seismic velocity response to an imposed surface wave to derive soil bulk modulus. After the desired depth or maximum advisable push load is obtained, the probe and connecting rods are typically removed from the ground.

Because of the efficiency of the CPT device push method, CPT push systems have been adapted to push other types of devices into the ground. Specifically relevant to this invention, these devices often include material sampling tools. Several devices have been previously developed for obtaining samples of soil, pore fluid and pore vapor. Desirable qualities of such tools should be that they withstand the extreme normal and shear loads applied to CPT-deployed probes during the push and retrieval processes, that they reliably obtain a quality sample of media from the area of interest, that they retain the sample during retrieval, and that they are easy to unload and redeploy without cross-contaminating additional samples.

Several attempts have been made to develop a soil sampler that embodies these qualities. Those designed to be opened after being pushed to the desired sampling depth have previously utilized two tip release devices and methods.

The first such device consists of load-bearing keys disposed between a movable tip assembly and an outer housing. The keys are displaced by inertial means when the housing is pulled upward with respect to the tip assembly. With the keys displaced, the housing can be driven further into the soil, thereby moving the housing relative to the movable tip assembly.

The second device releases a similar movable tip assembly by means of a lanyard lowered through an inner diameter of the cone rods, once the sampler has been pushed to a desired depth. The tip assembly includes hardened steel balls projecting radially outward into an inner radial groove within the housing. The lanyard engages and is secured to an upper portion of the tip assembly, which when displaced upward with respect to a lower portion of the tip assembly allows the steal balls to move radially inward out of the groove, thus releasing the tip assembly. Further upward motion of the lanyard pulls the tip assembly, both upper and lower sections, through the outer housing until reaching the upper end of the sampler.

Upon reaching the upper end of the sampler, an appropriate device fixed to the housing disengages the lanyard from the tip assembly to facilitate the removal of the lanyard prior to the retrieval of the sampler. The present invention improves upon the second device heretofore described.

Other devices exist which have been improved upon by the development of the devices described above. Such devices include samplers which do not provide a sealing means between the tip assembly and the outer housing prior to tip release and samplers which do not provide sufficient sample volume or reliable means for retaining the sample during retrieval.

The above-described soil sampling devices have several shortcomings.

The device of the first type described, using locking keys, relies upon inertial forces to release the locking mechanism between the tip and the housing. Such inertial forces presume a vertical push direction, parallel to normal gravitational forces. However, certain circumstances require pushing at an acute angle to vertical, such as when attempting to secure a sample underneath an object, for example, a storage tank, in which case the locking keys do not reliably disengage. Even during vertical pushes the keys may fail to disengage, at which point the operator has no indication that a failure has occurred until the sampler is retrieved.

Additionally, the release method requires the keys to be separate objects which must be manually set in place when assembling the sampler between each sampling operation. The use of appropriate environmental field apparel, such as work gloves, impedes the installation of such individual keys and makes field assembly difficult. Further, the release method of pulling upward on the outer housing disallows a common procedure of repeatedly displacing the rods up and down a few inches to work the probe through thin hard layers of soil. This procedure, commonly called "cycling", causes the tip assembly of this type of soil sampler to prematurely release before reaching a desired depth.

In addition, samplers of this type do not reliably retrieve samples from weak saturated soil layers because the weight of the released tip assembly bears upon the soil to be sampled as the housing is advanced. This weight prevents the soil from entering the sample chamber as required, as even small normal forces exacerbate the phenomenon of granular arching at the opening of the sample tube. Non-cohesive soils also present a difficulty to this tip release mechanism, as there must be sufficient retention of the conical tip surface in the soil to keep the tip from moving upward when the housing is raised to release the locking keys. Non-cohesive sandy soils, therefore, often keep the tip from releasing as required.

While attempting to address some of the above-described shortcomings by providing a means to actively release the locking mechanism, pull the released tip assembly through the sample chamber and retain it at the top of the chamber, prior examples of samplers of the second type described have had their own shortcomings. For example, the load bearing area, between the locking steel balls and the mating grooved surface, has not been sufficient to withstand the contact forces developed by pushing the sampler in harder geologic materials. The result in several instances is that the housing member containing the grooved surface will fracture during pushing. Another result of the high contact loads is that the grooved surface will deform with repeated loading and will have to be replaced.

The mechanical arrangement of balls in a groove is common to the design of radial ball bearings and works well for large radial loads combined with minor axial loads. The nature of this application to soil samplers requires the mechanism to withstand relatively high axial loads and almost no radial load.

Attempts to remove this limitation in current designs have been largely unsuccessful as they have compromised ease of use. In addition, samplers of this type have been unable to reliably obtain samples of loose, granular material which flow back out of the sample chamber during retrieval. Further, decontaminating the tip assemblies of such samplers has proven difficult due to the large number of individual members comprising the tip assembly and numerous small crevices which retain sample media.

SUMMARY OF THE INVENTION

The present invention provides an apparatus and method for obtaining a subterranean soil sample. The inventive method comprises the step of inserting the inventive apparatus into the ground. The inventive apparatus comprises an elongated housing having a passageway or sample chamber extending longitudinally therethrough, a tip assembly having upper and lower portions, a locking assembly, and a device lowered through the housing to release the locking assembly.

The elongated housing has three or more sections: a lower section, a middle section and an upper section. The tip assembly is positionable within the lower section of the housing such that a point of the tip assembly protrudes through a lower opening in the lower section and is prevented from moving further through the opening. The tip assembly comprises an upper portion, a lower portion and locking keys located there between which protrude radially into a groove in the lower section of the housing to prevent upward motion of the tip assembly with respect to the housing.

The tip assembly is designed such that when the upper portion is pulled upward and separated a predetermined amount with respect to the lower portion by means of a deployable lanyard, the locking keys are free to swing inward out of the radial groove in the housing. The locking keys are free to pivot on pins which are disposed between the upper and lower portions of the tip assembly. Further upward motion of the upper portion of the tip assembly also raises the lower portion and the locking keys, which are forced inward by acting against a tapered upper surface of the grooved surface in the housing, thereby releasing the tip assembly to be pulled through the middle section of the housing and into the upper section.

The present invention also provides a mechanism, in the form of an O-ring or other mechanical seal between the upper portion of the tip assembly and the inner surface of the middle and upper sections of the housing, to create a partial vacuum beneath the tip assembly as it is drawn through the housing during the sampling process, thereby assisting in the collection of very wet or granular materials within the sample chamber and in the retention of such materials within the chamber during retrieval.

After the tip assembly is retained in the upper section of the housing, the housing is lowered as required to fill the middle section of the housing with the desired sample of a volume of at least about 12 cubic inches, and preferably at least about 18 cubic inches. An optional resilient member acting as a one-way valve between the lower and middle sections of the housing can be used to retain granular material within the middle section during retrieval. This resilient valve can be in the form of a flexible ring with multiple curved members attached to the ring around its perimeter with little space between members so as to allow the passage of the tip assembly and soil up through the passageway but to effectively seal the passageway against downward material flow. The middle section of the housing can be fitted with removable sleeves to assist with sample removal once the sampler has been retrieved, and multiple middle sections can be used to increase the potential sample length.

In contrast to the soil sampling tools and methods used heretofore, the present invention allows the reliable collection of high quality soil samples through hard materials in a variety of media including loose granular wet sands, even during nonvertical sampling. Push loads of 20,000 pounds or more can be used as is required to traverse tough geologies and bring back a reasonably undisturbed sample of sufficient volume and diameter to meet most current environmental and geotechnical sampling requirements.

The inventive apparatus allows unlimited cycling of the sample tool to penetrate hard materials without premature release of the tip assembly, greatly increasing the potential benefits of CPT technology over alternate sampling methods. The ultimate strength of the inventive apparatus to withstand large push loads has been improved over previous devices that utilized lanyard release mechanisms, such improvement being effected by replacing locking balls with locking keys which provide a much higher load bearing area. In addition, the locking device is operated manually by the operator, providing tactile feedback through the lanyard cable that the release mechanism has functioned successfully.

Furthermore, securing the locking keys pivotably about pins eliminates the nuisance of losing components in the field and allows a simplified assembly procedure. In addition, the creation of a partial vacuum underneath the tip assembly by the method described herein improves upon the ability of previous sampling tools to reliably collect and retain a sample of wet or granular soil.

Accordingly, it is an object of the present invention to provide a soil sampler system including a housing and a tip assembly initially fixed at a leading end of the housing and movable towards the trailing end of the housing for obtaining a subterranean sample with the tip assembly including an upper portion and a lower portion movable with respect to each other within the housing and having at least one locking key pivotally mounted between the upper and lower portions and a portion of the locking key extending beyond a periphery of the upper and lower portions and engaging the housing when the tip assembly is fixed at the leading end of the housing and a portion of the locking key moving away from the housing and in between the upper and lower portions when the upper and lower portions move with respect to each other and together move towards the trailing end of the housing.

It is another object of the present invention to provide a soil sampler system including a housing and a tip assembly with the tip assembly including locking keys for fixing the position of the tip assembly at a leading end of the housing during penetration of the soil sampler system to a predetermined depth and upon lowering of a tip release bar to the tip assembly and engaging release latches, moving the tip assembly upwardly through the housing so that the tip assembly is released from engagement with the side wall of the housing and its fixed position for rearward movement within the housing while simultaneously creating a vacuum ahead of the tip assembly for ensuring retention of a soil sample upon further forward movement of the housing into the soil.

It is still yet another object of the present invention to provide a soil sampler system having a housing and tip assembly fixed at a leading end of the housing and have a soil catcher basket through which the tip assembly is slidable while simultaneously creating a vacuum ahead of the tip assembly to aid in retention of soil in conjunction with the soil catcher basket as the housing is further advanced into the soil.

Further objects, features, and advantages of the present invention will be readily apparent to those skilled in the art upon reference to the accompanying drawings and upon reading the following description of the preferred embodiments.

DETAILED DESCRIPTION OF THE PREFERRED EMBODIMENTS

Figure 1:
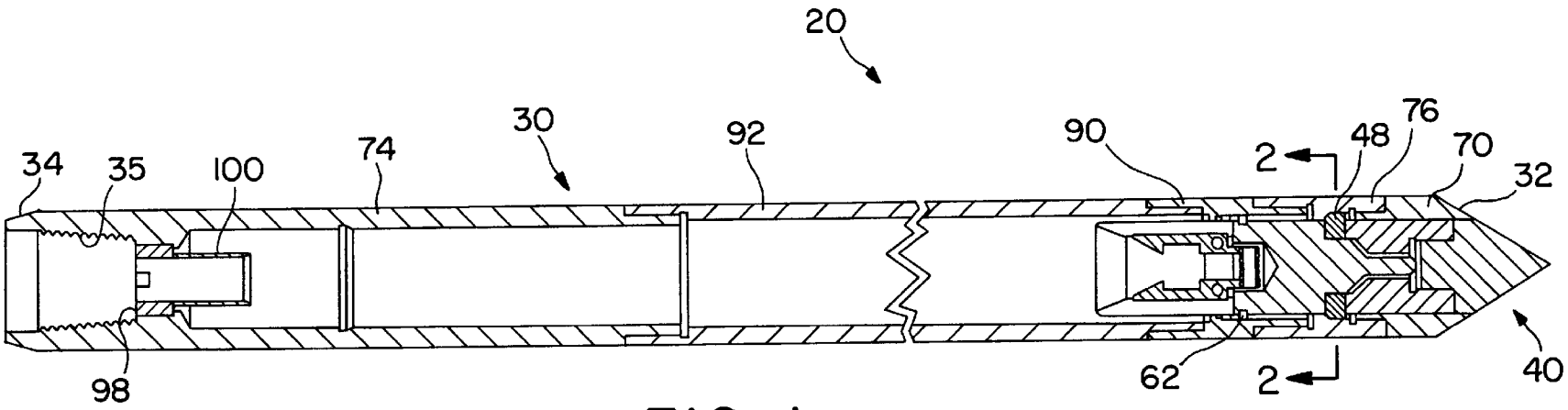
FIG. 1 provides a longitudinal sectional view of one embodiment of the soil sampling apparatus of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, a soil sampler embodying the teachings of the subject invention is generally designated as 20. With reference to its orientation in FIG. 1, the soil sampler comprises a housing 30 and a tip assembly 40. The housing includes an internal bore of approximately 1.1 inches in diameter, and preferably at least about 1.375 inches in diameter.

The tip assembly 40 is shown locked in the leading end 32 of the housing 30. This is the position in which the housing will be driven into the ground following CPT procedures.

At the trailing end 34 of the housing 30 is a threaded passageway 36 for receipt of hollow tubing in threaded engagement for driving the soil sampler into the ground. After a predetermined extent of driving the soil sampler into the ground, the tip assembly is movable towards the trailing end 34 of the housing by release of its locking engagement at the leading end 32 of the housing 30.

Figure 3:
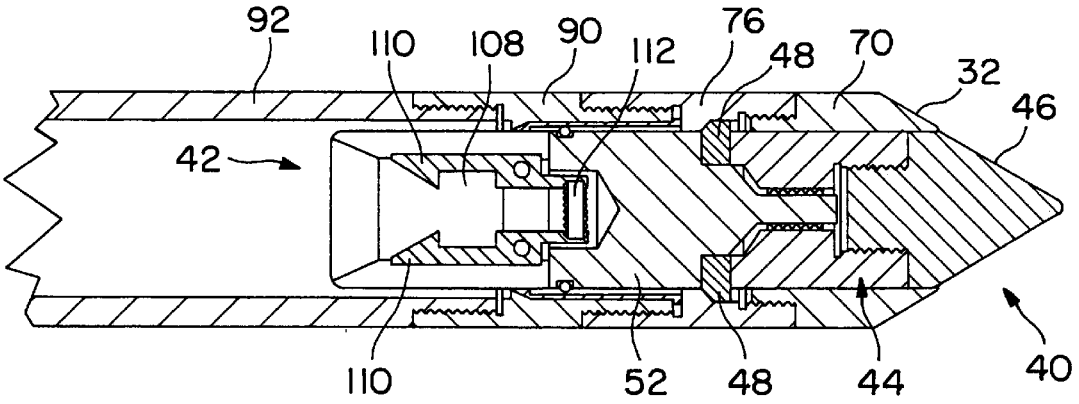
FIG. 3 provides an enlarged sectional view of the tip assembly as shown in FIG. 1, in the locked position with the locking keys engaging a sidewall of the housing.

With reference to FIG. 3, the locked position of the tip assembly is shown in greater detail. In this Figure, the upper portion 42 and the lower portion 44 of the tip assembly are shown. The lower portion 44 includes a conically shaped tip 46.

Located between the upper and lower portions 42, 44 are two locking keys 48. The locking keys are slidably mounted on a respective pin 50 which acts as a pivot pin for each of the locking keys 48. The pins 50 are fixed at one end to one of the upper and lower portions 42, 44 and is slidable into the other of the upper and lower portions 42, 44. Accordingly, in FIG. 3, the pins 50 are concealed, having slid, for example, into body block 52 and therefore are concealed in the drawing.

Figure 5:
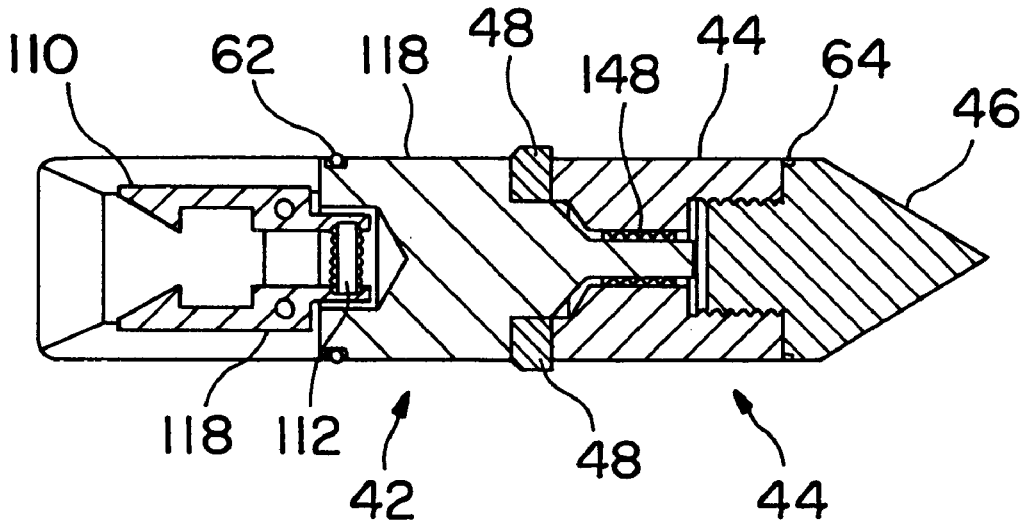
FIG. 5 illustrates the tip assembly holding the locking keys in an extended position between the upper and lower portions of the tip assembly.
Figure 6:
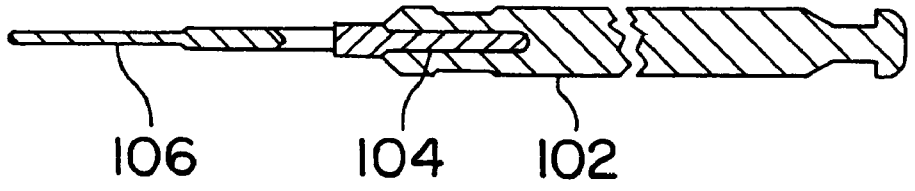
FIG. 6 illustrates cable secured to a tip release bar for engaging release latches of the tip assembly to separate the upper and lower portions of the tip assembly to a predetermined extent and allow inward pivoting of the locking keys for release of the tip assembly from the lower section of the housing and movement of the tip assembly up through the housing.

When the upper and lower portions of the tip assembly are adjacent to one another as shown in FIG. 3, the locking keys project beyond the periphery of the upper and lower portions 42, 44, respectively, as shown in FIG. 5. The portion of the locking keys projecting beyond the periphery of the upper and lower portion is engaged in the groove 54 located in an interior sidewall of the housing 30.

Figure 2:
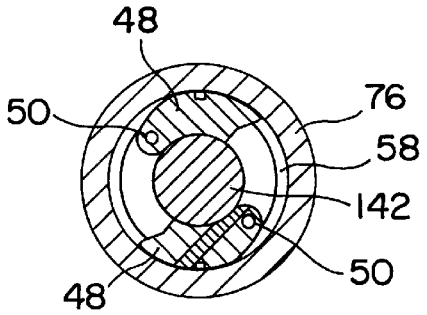
FIG. 2 provides a cross-sectional view of the inventive sampling apparatus taken along line 2—2 of FIG. 1, showing the pivotally mounted locking keys of the locking mechanism.

A stem 140 projecting from the body block 52 includes a shoulder 142, a tapered portion 144 and a cylindrical portion 146. As shown in FIG. 2, a diameter of the shoulder portion 142 is dimensioned to match a curvature of one side of the locking keys 48. The opposite side of the locking keys project into groove 54 in the sidewall of the housing 30 and are locked in place when the locking keys 48 engage the shoulder 142 of stem 140.

Figure 4:
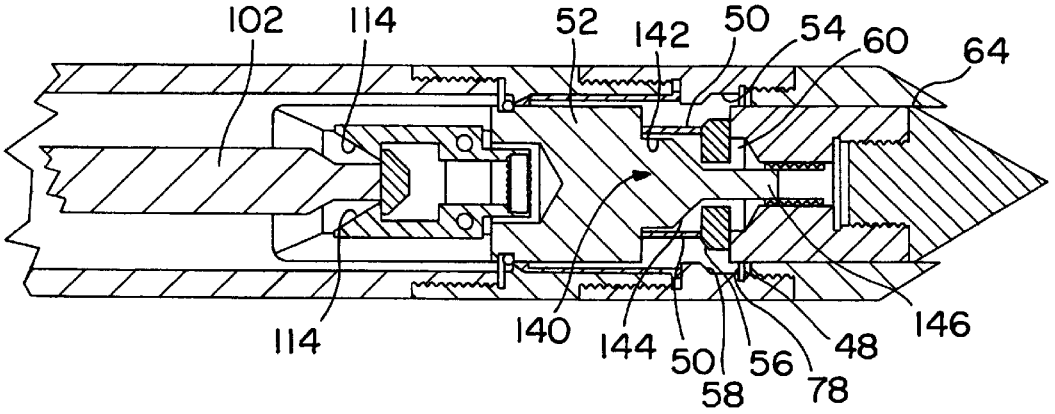
FIG. 4 provides an enlarged sectional view of the tip assembly shown in FIG. 1, however, in the released position with movement of the upper portion of the tip assembly up through the housing as pulled by a tip release bar to cause a chamfered edge of the locking keys to contact an inclined surface in the groove of the housing to pivot the locking keys inwardly and allow movement of the upper and lower portions of the tip assembly up through the housing.

When the upper and lower portions of the tip assembly are separated, as shown in FIG. 4, and the tip assembly is moved towards the trailing end 34 of the housing 30, cylindrical portion 146 of stem 140 is located adjacent to the keys 48. Continued movement of the cylindrical portion 146 out a bushing 148 in lower portion 44 of the tip assembly 40, causes engagement of a terminal end of the cylindrical portion 146 with an end of the bushing 148. The upper and lower portions of the tip assembly then slide together towards the trailing end 34 of the housing 30.

Meanwhile, a chamfered edge 56 of the locking keys 48 engages an inclined surface 58 of the groove 54 to pivot the locking keys about pins 50 towards cylindrical portion 146 and into the gap 60 formed between the upper and lower portions of the tip assembly. The chamfered edge 56 is inclined at a chamfer angle, with respect to a longitudinal axis of the housing of between about 50 and 70 degrees, and preferably about 60 degrees. This angle provides proper operation of the keys over a wide range of push angles. If the angle is too large, the keys will not easily disengage the housing shoulder (inclined shoulder 58); if they are too small, the housing hoop stress becomes to large. The total projected area of the shoulder-engaging chamfer of the key, in a transverse plane, should be at least 0.1 square inches, and preferably at least 0.141 square inches to withstand heavy or dynamic pushing. The cumulative area of all the keys should be at least 0.25 square inches, and preferably 0.275 square inches.

Accordingly, when the upper and lower portions of the tip assembly are adjacent to each other it is not possible for the locking keys to pivot out of engagement from the grove 54 (as restrained by shoulder 142), thereby locking the tip assembly at the leading end 32 of the casing with the tip 46 projecting therefrom.

Figure 7:
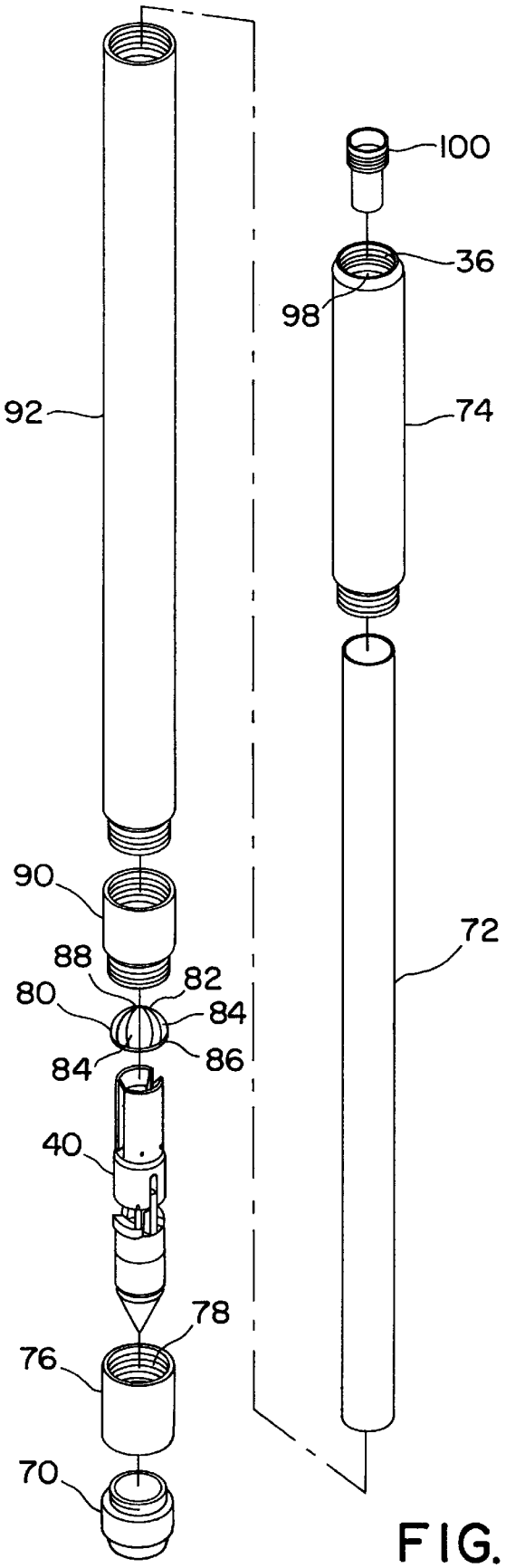
FIG. 7 is an exploded of the housing containing the tip assembly and a sample tube.
Figure 8:
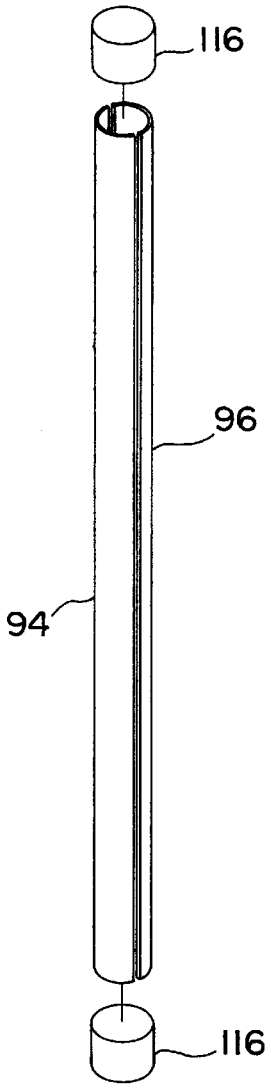
FIG. 8 is an exploded view of an alternative sample tube and tube caps.
Figure 9:
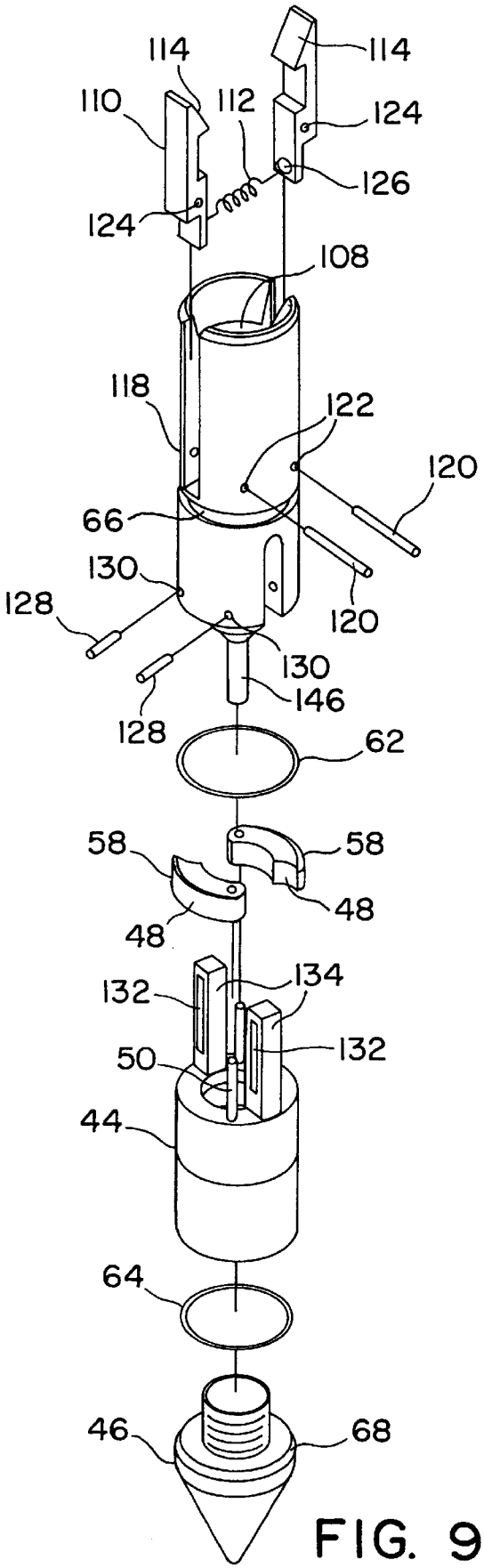
FIG. 9 is an exploded view of the tip assembly.
Figure 10:
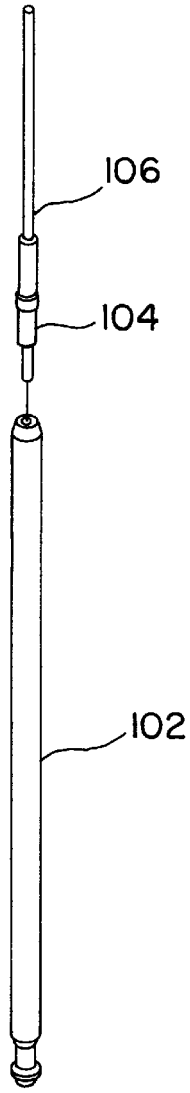
FIG. 10 is an exploded view of the cable and tip release bar.

The soil sampler is assembled as will be explained with reference to FIGS. 7, 8 and 9.

After cleaning and decontamination of the components of the soil sampler, an upper O-ring 62 and a lower O-ring 64 are placed in O-ring grooves 66, 68, respectively, of the tip assembly 40. The lower O-ring 64 seals the tip 46 in the cutting sleeve 70 of the housing 30 so that soil and water cannot enter the sampler prior to obtaining a sample and so that soil will not jam the tip in the cutting sleeve. The upper O-ring 62 produces a vacuum in the sample tube 72 during retraction of the tip 46 to help ensure positive sample retention. Upper O-ring 62 also secures the tip 46 inside the tip catch housing 74 of the housing 30 following tip retraction. The tip assembly 40 and cutting sleeve 70 can be lubricated with a light coat of vegetable oil, cooking spray or other permissible lubricant to provide smoother operation.

With the tip assembly in a vertical position, with the tip pointing down, the tip assembly is slid down through the locking sleeve 76 of housing 30 with the locking keys 48 manually moved inwardly into their unlocked position, until the O-ring 62 rests on a shoulder 78 of the locking sleeve 76 adjacent to groove 54.

The cutting sleeve 70 is slid upward over the tip 46 of the tip assembly 40 and threaded into the bottom of the locking sleeve 76. This will force the locking keys 48 outward into the locked position as the upper portion 42 of the tip assembly 40 is lowered towards the lower portion 44 for threading of the cutting sleeve 70 into the locking sleeve 76.

A soil catcher basket 80, domed end 82 up, is slid over the tip assembly 40 until it seats against the locking sleeve 76. The catcher basket includes a plurality of wedge shaped members 84 extending from a base ring 86 to an apex 88. The wedges 84, being anchored at only one end can be separated for passage of material, such as a soil sample, up into the housing 30.

An upper sleeve 90 is threaded into the top of the locking sleeve 76. A barrel 92 of the housing 30 is threaded into the upper end of upper sleeve 90.

Cylindrical sample tube 72 is inserted into the barrel 92. Alternatively, split sample tube sections 94, 96 (as shown in FIG. 8) can be used in place of the cylindrical sample tube 72.

The tip catch housing 74 is then threaded into the upper end of barrel 92. All threaded connections are gently tightened with adjustable wrenches.

The soil sampler is maintained in a vertical orientation until it enters the ground to ensure that the upper portion 42 of the tip assembly 40 does not slide upward, which would permit the locking keys 48 to disengage from groove 54 and move into the thus formed gap 60 in the interior of locking sleeve 76. The sampler is now ready to be pushed into the ground.

To obtain a soil sample, the soil sampler of the present invention is attached to the CPT rods by threading the bottom CPT rod into the threaded opening 36 of the upper end of tip catch housing 74. Care is taken to keep the soil sampler vertically oriented with the tip 46 down at all times to ensure that the tip assembly 40 remains locked in position.

After pushing the soil sampler to the desired depth, tip release bar 102 joined at coupling 104 with cable 106 is lowered through the push rods until the tip release bar 102 enters into a gap 108 between opposed latches 110 as shown in FIG. 4. The housing 30 of the soil sampler is retracted a small amount to relieve the soil pressure at the tip 46.

To release the tip from its locking position, the cable 106 is pulled upwardly. If there is no resistance, this means that the tip release bar has not engaged the latches 110. If this happens, the cable is pulled up about half a meter (20 inches) and dropped. The release bar 102 should then be engaged in the gap 108 between the latches 110 of the tip assembly by overcoming the inward bias of the latches 110 from spring 112.

The cable is pulled up until the upper portion 42 of the tip assembly has moved away from the lower portion 44 to an extent limited by stem 140 and pins 50. The upper and lower portions are then moved together as a unit until reaching the top of the tip catch housing 74 (about 0.6 meters or 2 feet). During initial movement of the upper and lower portions 42, 44 together, the chamfered edges 56 of locking keys 48 engage inclined surface 58 of groove 54 to move the locking keys into the gap 60 formed by the separation of the upper and lower portions 42, 44.

At the top of tip catch housing 74, the inclined planes 114 of the latches 110 engage the unlatch tube 100 to spread the latches 110 apart and release the tip release bar 102. The tip release bar is then retracted to the surface.

The housing 30 is then advanced by pushing on the CPT rods to fill the sample tube 72. A quasi-static load of at least 10 tons can be applied to the sampler to advance the sampler through the ground. The push distance required to fill the tube will vary with soil conditions. A push distance of about 0.61 meters (2.0 feet) is preferred. Alternatively the tip assembly can be held in place while the housing is advanced to obtain a soil sample.

The CPT rods and the soil sampler is then retracted to the surface. The tip catch housing 74 is then unthreaded from the barrel 92. The tip assembly 40 can be removed from the tip catch housing 74 by shaking the housing 74.

The filled sample tube 72 is removed from the barrel 92. The sample may be extruded from the sample tube 72 in the field or the entire tube may be sealed for later shipment or analysis by capping it with two sample tube caps 116.

To assembly the tip assembly 40, one of the release latches 110 is placed into the release body 118 and pinned with roll pin 120 passing thru hole 122 in the body 118 and hole 124 in the latch 110. Spring 112 is pushed into the recess 126 on the other release latch 110. This assembly is placed into gap 108 in the release body 118 carefully aligning the spring 112 with the first latch 110. The other roll pin 120 is then inserted thru opening 122, 124. O-ring 62 is installed in the O-ring groove 66 in the release body 118. The two locking keys 48 are installed over the pins 50 on the tip receiver 44 making sure that the chamfers 58 on the keys 48 face upward and that the keys 48 pivot freely on pins 50.

The tip receiver 44 is secured to the release body 118 by passing roll pins 128 thru openings 130 in the release body 116. The pins 128 pass thru slots 132 in posts 134 extending from tip receiver 44.

Tip 46 is screwed into the tip receiver 44 and tightened with an adjustable wrench and a pipe wrench. O-ring 64 is then installed in the O-ring groove 68 in the tip 46.

The release body 118 and tip receiver 44 are thereby movable with respect to each other, limited by the pins 128 sliding within the slots 132 and by cylindrical portion 146 sliding in bushing 148. At the furthest limit of a separation of the release body 118 and the tip receiver 44, a gap 60 is formed which allows receipt of the locking keys 48 in their inwardly pivoted position.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A sampler for obtaining a subterranean material sample, said sampler comprising:

an elongated housing defining an internal bore with a longitudinal axis and an internal shoulder, and a tip assembly movable within said bore, said tip assembly including an upper portion, a lower portion having an outer surface for engaging subterranean material, and a key pivotally mounted between the upper and lower portions about an axis extending substantially parallel to the longitudinal axis, the key having a load surface arranged to engage the internal shoulder of the housing in a locking position to retain the tip assembly in a predetermined position within the housing and to allow the tip assembly to be moved past the internal shoulder through the housing bore in a releasing position to obtain a sample.

2. The sampler of claim 1, wherein the tip assembly further comprises a pin extending axially between the upper and lower portions for pivotably mounting the key.

3. The sampler of claim 1, wherein the outer surface of the lower portion of the tip assembly is movable to displace a volume of at least about 12 cubic inches.

4. The sampler of claim 3, wherein the outer surface of the lower portion of the tip assembly is movable to displace a volume of at least about 18 cubic inches.

5. The sampler of claim 1, wherein the inner bore of the housing is at least about 1.1 inches in diameter.

6. The sampler of claim 5, wherein the inner bore of the housing is at least about 1.375 inches in diameter.

7. A sampler of claim 1, wherein the internal shoulder of the housing and a load surface of the key each define a chamfer, the chamfer of the key is arranged to engage the chamfer of the shoulder when the key is in the locking position.

8. The sampler of claim 7, wherein the chamfer of the shoulder is inclined at a chamfer angle, with respect to the longitudinal axis of the housing, of between about 50 and 70 degrees.

9. The sampler of claim 8, wherein the chamfer angle is about 60 degrees.

10. The sampler of claim 1, wherein the upper portion of the tip assembly is axially displaceable with respect to the lower portion to a predetermined extent to release the key.

11. The sampler of claim 10, wherein the upper portion of the tip assembly has a radially outwardly directed surface for preventing movement of said key to the releasing position until the upper portion has been axially displaced.

12. The sampler of claim 10, wherein the upper portion of the tip assembly includes a latch for releasably receiving a tip-releasing tool lowered through the internal bore.

13. The sampler of claim 12, further comprising a tool release sleeve for disengaging the tip-releasing tool from the upper portion after the upper portion has been pulled along a length of the internal bore.

14. The sampler of claim 1, wherein the tip assembly further comprises a seal for sealing the tip assembly and the internal bore, as the tip assembly is moved along the internal bore, to reduce the pressure between the lower portion of the tip assembly and the soil.

15. The sampler of claim 1, wherein the housing and tip assembly are constructed to withstand a static, axial load, between the lower portion of the tip assembly and the housing, of at least 20,000 pounds.

16. A soil sampler system for attaching to a leading end of a cone penetrometer testing device, said soil sampler system comprising:

a housing, and p1 a tip assembly initially fixed at a leading end of said housing and movable towards a trailing end of said housing for obtaining a subterranean sample, said tip assembly including an upper portion and a lower portion movable with respect to each other within said housing and including biased latches for engaging a tip release rod, at least one locking key pivotally mounted between said upper portion and said lower portion, and a portion of said at least one locking key extending beyond a periphery of said upper portion and said lower portion and engaging a groove located in an interior wall of said housing when said tip assembly is fixed at said leading end of said housing and said portion of said at least one locking key moving away from said housing and entirely in between said upper portion and said lower portion when said upper portion and said lower portion are moved with respect to each other and then moved together towards said trailing end of said housing.

17. A soil sampler system as claimed in claim 16, wherein said upper portion and said lower portion are separable to a predetermined extent, and said at least one locking key is movable into a gap formed between said upper portion and said lower portion when said upper portion and said lower portion are separated.

18. A soil sampler system as claimed in claim 16, wherein a sample retaining tube is located in said housing.

19. A soil sampler system as claimed in claim 16, wherein a tip release rod passes through said housing and engages said upper portion for initially separating said upper portion from said lower portion and for retraction of both said upper portion and said lower portion towards said trailing end of said housing.

20. A soil sampler system as claimed in claim 16, wherein said tip assembly includes a surface for limiting inward pivotal movement of said at least one key and thereby locking said at least one key in a groove in said housing.

21. A soil sampler system as claimed in claim 16, wherein an O-ring surrounding said tip assembly and engaging said housing creates a seal between said tip assembly and said housing for forming at least a partial vacuum below said tip assembly when said tip assembly is moved through said housing.

22. A soil sampler system as claimed in claim 16, wherein said tip release rod is lowered through said housing from ground level and retracted during a sample collecting operation.

23. A soil sampler system as claimed in claim 17, wherein said upper portion and said lower portion of said tip assembly are separable by a pin and slot connection.

24. A soil sampler system as claimed in claim 16, wherein at least one of said at least one locking key and said groove include an inclined surface for moving said at least one locking key radially inwardly during movement of said tip assembly in said housing.

25. An apparatus for obtaining a subterranean material sample, said apparatus comprising:

an elongated housing having a passageway extending longitudinally therethrough, a tip assembly positionable within said passageway so that said tip assembly protrudes through an opening at one end of said passageway, said tip assembly being movable within said passageway, said housing including a sleeve to release said tip assembly when said tip assembly reaches an upper end of said housing, at least one locking key of said tip assembly for releasably preventing said tip assembly from moving from said one end of said passageway to an opposite end of said passageway, a radial surface on said tip assembly preventing said at least one locking key from moving out of a groove in said passageway until a portion of said tip assembly is moved a limited distance with respect to said locking key, and a tapered upper surface of said groove applying a centering force to said at least one locking key to displace said at least one locking key inwardly towards a center of said tip assembly when said radial surface is displaced axially and a pulling force is applied to said tip assembly.

26. An apparatus as described in claim 25, further comprising a mechanical seal between said tip assembly and an inner surface of said housing, said seal providing a reduced pressure beneath said tip assembly as said tip assembly is pulled through said housing.

27. An apparatus as described in claim 25, wherein said at least one locking key is pivotably attached to said tip assembly with a pin disposed between an upper portion and a lower portion of said tip assembly.

28. An apparatus as described in claim 25, wherein said sleeve includes a rigid tube for disengaging pivotable pawls on said tip assembly.

29. A method of obtaining a subterranean material sample utilizing a sampling apparatus comprising an elongated housing having a passageway extending longitudinally therethrough, a tip assembly positionable within said passageway such that said tip assembly protrudes through an opening of said passageway, said tip assembly being movable within said passageway from one end to an opposite end of said passageway, at least one locking key for releasably preventing said tip assembly from moving from said one end of said passageway to said opposite end of said passageway, a radial surface on said tip assembly which prevents said locking key from moving out of a groove in said passageway until a portion of said tip assembly is moved upward a limited distance with respect to said locking key, and a tapered upper surface of said groove applying a centering force to said locking key to displace said locking key inwardly towards a center of said tip assembly when said radial surface is displaced axially and a pulling force is applied to said tip assembly, said method comprising the steps of:

assembling the sample apparatus with the tip assembly protruding through the opening of said passageway and the at least one locking key being disposed within said groove in said passageway, inserting the assembled sampling apparatus into the ground, releasing said locking key to permit said tip assembly to move from said one end of said passageway to said opposite end of said passageway, and advancing said housing into the ground to insure at least partial filling with sample material of a sample chamber disposed within said housing.

30. A method as described in claim 29, wherein a tip releasing tool is lowered into the sampling apparatus to engage the tip assembly.

31. A method as described in claim 30, wherein said sampling apparatus produces a reduced pressure beneath said tip assembly as said tip assembly is pulled through said housing by the tip releasing tool.

32. A method as described in claim 29, wherein said locking key is pivoted on a pin disposed between an upper portion and a lower portion of said tip assembly.

33. A method as described in claim 29, wherein a maximum separation distance between an upper portion and a lower portion of said tip assembly is limited by at least one pin disposed within said upper portion of said tip assembly moving within a slot in said lower portion of said tip assembly.

34. A method as described in claim 29, wherein a maximum separation distance between an upper portion and a lower portion of said tip assembly is limited by at least one pin disposed within said upper portion of said tip assembly moving within a slot in said lower portion of said tip assembly.

35. A method as described in claim 34, wherein the step of advancing the housing exposes the internal bore of the housing to subterranean material.

36. A method as described in claim 34, wherein the sampling apparatus further comprises a core catcher disposed at a lower end of the internal bore of the housing, the step of advancing the housing including forcing the tip assembly and sample material through the core catcher.

37. A method as described in claim 34, further comprising, before the step of inserting the sampling apparatus, placing a sample tube within the internal bore of the housing.

38. A soil sampler system for attaching to a leading end of a cone penetrometer testing device, said soil sampler system comprising:

a housing, a sample retaining tube located in said housing, and a tip assembly initially fixed at a leading end of said housing and movable towards a trailing end of said housing for obtaining a subterranean sample, said tip assembly including an upper portion and a lower portion movable with respect to each other within said housing, at least one locking key pivotally mounted between said upper portion and said lower portion, and a portion of said at least one locking key extending beyond a periphery of said upper portion and said lower portion and engaging said housing when said tip assembly is fixed at said leading end of said housing and said portion of said at least one locking key moving away from said housing and entirely in between said upper portion and said lower portion when said upper portion and said lower portion are moved with respect to each other and then moved together towards said trailing end of said housing.

39. A soil sampler system as claimed in claim 38, wherein said at least one locking key engages a groove located in an interior wall of said housing.

40. A soil sampler system as claimed in claim 38, wherein said upper portion and said lower portion are separable to a predetermined extent, and said at least one locking key is movable into a gap formed between said upper portion and said lower portion wherein said upper portion and said lower portion are separated.

41. A soil sampler system as claimed in claim 38, wherein a tip release rod passes through said housing and engages said upper portion for initially separating said upper portion from said lower portion and for retraction of both said upper portion and said lower portion towards said trailing end of said housing.

42. A soil sampler system as claimed in claim 38, wherein said tip assembly includes biased latches for engaging a tip release rod.

43. A soil sampler system as claimed in claim 42, wherein said tip release rod is lowered through said housing from ground level and retracted during a sample collecting operation.

44. A method of obtaining a subterranean material sample utilizing a sampling apparatus comprising an elongated housing having a passageway extending longitudinally therethrough, a tip assembly positionable within said passageway such that said tip assembly protrudes through an opening of said passageway, said tip assembly being movable within said passageway from one end to an opposite end of said passageway, at least one locking key for releasably preventing said tip assembly from moving from said one end of said passageway to said opposite end of said passageway, a radial surface on said tip assembly which prevents said locking key from moving out of a groove in said passageway until a portion of said tip assembly is moved upward a limited distance with respect to said locking key, and a tapered upper surface of said groove applying a centering force to said locking key to displace said locking key inwardly towards a center of said tip assembly when said radial surface is displaced axially and a pulling force is applied to said tip assembly, said method comprising the steps of:

inserting said sampling apparatus into the ground, releasing said locking key to permit said tip assembly to move from said one end of said passageway to said opposite end of said passageway, advancing said housing into the ground to insure at least partial filling with sample material of a sample chamber disposed within said housing, and limiting a maximum separation distance between an upper portion and a lower portion of said tip assembly by at least one pin disposed within said upper portion of said tip assembly moving within a slot in said lower portion of said tip assembly.

45. A method of obtaining a subterranean material sample utilizing a sampling apparatus comprising an elongated housing defining an internal bore with a longitudinal axis and an internal shoulder, and a tip assembly movable within said bore, said tip assembly including an upper portion, a lower portion having an outer surface for engaging subterranean material, and a key pivotally mounted between the upper and lower portions about an axis extending substantially parallel to the longitudinal axis, the key having a load surface arranged to engage the internal shoulder of the housing in a locking position to retain the tip assembly in a predetermined position within the housing and to allow the tip assembly to be moved past the internal shoulder through the housing bore in a releasing position to obtain a sample, said method comprising the steps of:

inserting said sampling apparatus into the ground, releasing said locking key to permit said tip assembly to move from said one end of said passageway to said opposite end of said passageway, and advancing said housing into the ground to at least partially fill said internal bore of the housing with sample material.

* * * * *